US011842683B2

(12) United States Patent
Yuan et al.

(10) Patent No.: US 11,842,683 B2
(45) Date of Patent: Dec. 12, 2023

(54) DISPLAY APPARATUS, DISPLAY PANEL AND DRIVING METHOD THEREOF, AND METHOD OF DETECTING PIXEL CIRCUIT

(71) Applicants: Hefei BOE Joint Technology Co.,Ltd., Hefei (CN); BOE TECHNOLOGY GROUP CO., LTD., Beijing (CN)

(72) Inventors: Can Yuan, Beijing (CN); Yongqian Li, Beijing (CN); Zhidong Yuan, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/620,212

(22) PCT Filed: Dec. 23, 2020

(86) PCT No.: PCT/CN2020/138657
§ 371 (c)(1),
(2) Date: Dec. 17, 2021

(87) PCT Pub. No.: WO2022/133812
PCT Pub. Date: Jun. 30, 2022

(65) Prior Publication Data

US 2022/0406253 A1 Dec. 22, 2022

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 2300/0426; G09G 2300/0819; G09G 2300/0842; G09G 2320/0295; G09G 2320/045
See application file for complete search history.

(56) References Cited

U.S. PATENT DOCUMENTS 8,836,691 B2 9/2014 Ryu et al.
9,318,050 B2 4/2016 Ryu et al.
(Continued)

FOREIGN PATENT DOCUMENTS

CN 103208259 A 7/2013
CN 105427794 A 3/2016
(Continued)

OTHER PUBLICATIONS

Written Opinion for International Application No. PCT/CN2020/138657 dated Sep. 26, 2021.
(Continued)

*Primary Examiner* — Stacy Khoo
(74) *Attorney, Agent, or Firm* — Perilla Knox & Hildebrandt LLP; Kenneth A. Knox

(57) ABSTRACT

A display apparatus, a display panel, and a driving method thereof, and a method of detecting a pixel circuit are described. The display panel includes a pixel unit and a detection apparatus, and the pixel unit includes a pixel circuit and a light-emitting element. The pixel circuit includes a first transistor, a second transistor, a driving transistor, and a storage capacitor. The detection device is configured to: turn off the first transistor and the second transistor, and detect an amount of current leakage of the driving transistor leaked through the sensing line to obtain a first current leakage parameter; detect a first characteristic parameter of the driving transistor to obtain a first reference characteristic parameter; and determine a first target char-
(Continued)

acteristic parameter according to the first current leakage parameter and the first reference characteristic parameter.

20 Claims, 8 Drawing Sheets

(52) U.S. Cl.
CPC ..... *G09G 2300/0842* (2013.01); *G09G 2320/0295* (2013.01); *G09G 2320/045* (2013.01)

(56) References Cited

U.S. PATENT DOCUMENTS

| | | | |
|---|---|---|---|
| 10,657,902 | B2 | 5/2020 | Lee et al. |
| 10,964,273 | B2 | 3/2021 | Oh et al. |
| 2011/0007067 | A1 | 1/2011 | Ryu et al. |
| 2015/0062199 | A1 | 3/2015 | Ryu et al. |
| 2016/0189618 | A1 | 6/2016 | Park et al. |
| 2016/0203764 | A1 | 7/2016 | In et al. |
| 2017/0372655 | A1 | 12/2017 | Wang et al. |
| 2018/0061329 | A1 | 3/2018 | Lee et al. |
| 2018/0190192 | A1 | 7/2018 | Kwon et al. |
| 2020/0043414 | A1 | 2/2020 | Wang |
| 2020/0111424 | A1 | 4/2020 | Oh et al. |
| 2020/0135072 | A1 | 4/2020 | Min et al. |
| 2022/0157261 | A1* | 5/2022 | Kim ..... G09G 3/3233 |

FOREIGN PATENT DOCUMENTS

| | | | |
|---|---|---|---|
| CN | 107784973 | A | 3/2018 |
| CN | 108091299 | A | 5/2018 |
| CN | 108986748 | A | 12/2018 |
| CN | 110383369 | A | 10/2019 |
| CN | 110767132 | A | 2/2020 |
| CN | 111028783 | A | 4/2020 |
| CN | 111899691 | A | 11/2020 |
| CN | 110767132 | B | 2/2021 |
| WO | 2021077495 | A1 | 4/2021 |

OTHER PUBLICATIONS

Extended European Search Report for EP Patent Application No. 20966389.7 dated Aug. 4, 2023.

* cited by examiner

FIG. 3 *(Prior Art)*

FIG. 5 *(Prior Art)*

FIG. 6 *(Prior Art)*

DISPLAY APPARATUS, DISPLAY PANEL AND DRIVING METHOD THEREOF, AND METHOD OF DETECTING PIXEL CIRCUIT

CROSS-REFERENCE TO RELATED APPLICATION

This application is the national phase application under 35 U.S.C. § 371 of International Application No. PCT/CN2020/138657 filed Dec. 23, 2020, the contents of which being incorporated by reference in their entirety herein.

TECHNICAL FIELD

The present disclosure relates to the field of display technology, and in particular, to a display apparatus, a display panel and a driving method thereof, and a method of detecting a pixel circuit.

BACKGROUND

A pixel unit in a display panel generally includes a light-emitting element and a pixel circuit connected to each other, and the pixel circuit can output a driving current to the light-emitting element to drive the light-emitting element to emit light. Due to the influence of factors such as the drift of the threshold voltage of the transistor in the pixel circuit, the driving current output by the pixel circuit to the light-emitting element is prone to generating abnormality.

In the related art, the pixel circuit can usually be compensated by means of internal compensation or external compensation, to solve the problem of abnormal driving current output to the light-emitting element due to the drift of the threshold voltage.

It should be noted that the information disclosed in the above BACKGROUND is only used to enhance the understanding of the background of the present disclosure, and therefore may include information that does not constitute the prior art known to those of ordinary skill in the art.

SUMMARY

The present disclosure provides a display apparatus, a display panel, and a driving method thereof, and a method of detecting a pixel circuit.

According to one aspect of the present disclosure, there is provided a display panel, including:

a plurality of pixel units, wherein each of the pixel units includes a pixel circuit and a light-emitting element connected to each other, and the pixel circuit includes:

a first transistor, wherein a first electrode of the first transistor is connected to a data line;

a driving transistor, wherein a control terminal of the driving transistor is connected to a second electrode of the first transistor, and a first electrode of the driving transistor is connected to a first power terminal;

a second transistor, wherein a first electrode of the second transistor is connected to a second electrode of the driving transistor, and a second electrode of the second transistor is connected to a sensing line;

a storage capacitor, connected between the control terminal of the driving transistor and the light-emitting element;

a detection device, wherein the detection device is configured to:

in a first time period in a first state of the pixel unit, turn off the first transistor and the second transistor, and detect an amount of current leakage of the driving transistor leaked through the sensing line to obtain a first current leakage parameter;

in a second time period after the first time period in the first state, detect a first characteristic parameter of the driving transistor to obtain a first reference characteristic parameter;

determine a first target characteristic parameter according to the first current leakage parameter and the first reference characteristic parameter.

In an exemplary embodiment of the present disclosure, detecting an amount of current leakage of the driving transistor leaked through the sensing line to obtain a first current leakage parameter includes:

inputting a first reference voltage to the sensing line at an initial moment of the first time period;

detecting a voltage of the sensing line at an end moment of the second time period, to obtain a first target voltage;

determining the first current leakage parameter according to the first target voltage and the first reference voltage.

In an exemplary embodiment of the present disclosure, the detection device is further configured to:

reset the voltage of the sensing line in a first reset time period between the first time period and the second time period.

In an exemplary embodiment of the present disclosure, the first time period and the second time period have an identical duration.

In an exemplary embodiment of the present disclosure, the first characteristic parameter is a threshold voltage; and the first state is a non-display state.

In an exemplary embodiment of the present disclosure, detecting a first characteristic parameter of the driving transistor to obtain a first reference characteristic parameter includes:

turning on the first transistor and the second transistor, writing a first reference voltage to the control terminal of the driving transistor, and writing a first starting voltage to the second electrode of the driving transistor, such that the driving transistor is turned on;

inputting a current to the first electrode of the driving transistor, and detecting a voltage of the second electrode of the driving transistor when the driving transistor is turned off, as the first reference characteristic parameter.

In an exemplary embodiment of the present disclosure, the detection device is further configured to:

in a third time period in the second state of the pixel unit, turn off the first transistor and the second transistor, and detect an amount of current leakage of the driving transistor leaked through the sensing line to obtain a second current leakage parameter;

in a fourth time period after the third time period in the second state, detect a second characteristic parameter of the driving transistor to obtain a second reference characteristic parameter;

determine a second target characteristic parameter according to the second current leakage parameter and the second reference characteristic parameter.

In an exemplary embodiment of the present disclosure, detecting an amount of current leakage of the driving transistor leaked through the sensing line to obtain a second current leakage parameter includes:

enabling the sensing line to input a second reference voltage at an initial moment of the third time period;

detecting a voltage of the sensing line at an end moment of the third time period, to obtain a second target voltage;

determining the second current leakage parameter according to the second target voltage and the second reference voltage.

In an exemplary embodiment of the present disclosure, the detection device is further configured to:

reset the sensing line in a second reset time period between the third time period and the fourth time period.

In an exemplary embodiment of the present disclosure, the third time period and the fourth time period have an identical duration.

In an exemplary embodiment of the present disclosure, the second characteristic parameter is mobility; the second state is a display state;

the third time period, the second reset time period and the fourth time period are in a blanking stage.

In an exemplary embodiment of the present disclosure, detecting a second characteristic parameter of the driving transistor to obtain a second reference characteristic parameter includes:

in a reset stage, turning on the first transistor and the second transistor, inputting a second reference voltage to the control terminal of the driving transistor, wherein the second reference voltage is equal to a sum of a basic voltage and the first characteristic parameter; and inputting a reset voltage to the sensing line;

in a charging stage, turning on the second transistor, and the driving transistor inputting a driving current to the sensing line under an action of a detection voltage, such that the voltage of the sensing line gradually rises;

in a detecting stage, detecting the voltage of the sensing line to obtain the detection voltage;

in a processing stage, determining the second reference characteristic parameter of the driving transistor according to the second reference voltage and the detection voltage.

According to one aspect of the present disclosure, there is provided a method of detecting a pixel circuit, wherein the pixel circuit includes a first transistor, a second transistor, a driving transistor, and a storage capacitor, a first electrode of the first transistor is connected to a data line; a control terminal of the driving transistor is connected to a second electrode of the first transistor, and a first electrode of the driving transistor is connected to a first power terminal; a first electrode of the second transistor is connected to a second electrode of the driving transistor, and a second electrode of the second transistor is connected to a sensing line; the storage capacitor is connected between the control terminal of the driving transistor and the light-emitting element;

the detection method includes:

in a first time period in a first state of the pixel unit, turning off the first transistor and the second transistor, and detecting an amount of current leakage of the driving transistor leaked through the sensing line to obtain a first current leakage parameter;

in a second time period after the first time period in the first state, detecting a first characteristic parameter of the driving transistor to obtain a first reference characteristic parameter;

determining a first target characteristic parameter according to the first current leakage parameter and the first reference characteristic parameter.

In an exemplary embodiment of the present disclosure, detecting an amount of current leakage of the driving transistor leaked through the sensing line to obtain a first current leakage parameter includes:

inputting a first reference voltage to the sensing line at an initial moment of the first time period;

detecting a voltage of the sensing line at an end moment of the second time period, to obtain a first target voltage;

determining the first current leakage parameter according to the first target voltage and the first reference voltage.

In an exemplary embodiment of the present disclosure, the first characteristic parameter is a threshold voltage; and the first state is a non-display state.

In an exemplary embodiment of the present disclosure, the detection device is further configured to:

in a third time period in the second state of the pixel unit, turn off the first transistor and the second transistor, and detect an amount of current leakage of the driving transistor leaked through the sensing line to obtain a second current leakage parameter;

in a fourth time period after the third time period in the second state, detect a second characteristic parameter of the driving transistor to obtain a second reference characteristic parameter;

determine a second target characteristic parameter according to the second current leakage parameter and the second reference characteristic parameter.

In an exemplary embodiment of the present disclosure, detecting an amount of current leakage of the driving transistor leaked through the sensing line to obtain a second current leakage parameter includes:

enabling the sensing line to input a second reference voltage at an initial moment of the third time period;

detecting a voltage of the sensing line at an end moment of the third time period, to obtain a second target voltage;

determining the second current leakage parameter according to the second target voltage and the second reference voltage.

In an exemplary embodiment of the present disclosure, the second characteristic parameter is mobility; the second state is a display state;

the third time period, the second reset time period and the fourth time period are in a blanking stage.

According to one aspect of the present disclosure, there is provided a method of driving a display panel, wherein the display panel includes a plurality of pixel units, and each of the pixel units includes a pixel circuit and a light-emitting element connected to each other; the driving method includes:

detecting a first target characteristic parameter of each of driving transistors in the pixel circuit by using the detection method according to any one of the above;

in a display state of the display panel, compensating a data signal of the pixel circuit where the driving transistor is located according to a first target characteristic parameter of the driving transistor.

According to one aspect of the present disclosure, there is provided a display apparatus, including the display panel according to any one of the above.

It should be understood that the above general description and the following detailed description are only exemplary and explanatory, and cannot limit the present disclosure.

BRIEF DESCRIPTION OF THE DRAWINGS

The drawings herein are incorporated into the specification and constitute a part of the specification, show embodiments in accordance with the disclosure, and explain the principle of the disclosure together with the specification. The drawings in the following description are only some embodiments of the present disclosure. For those of ordinary skill in the art, other drawings can be obtained based on these drawings without creative work.

DETAILED DESCRIPTION

Figure 1:
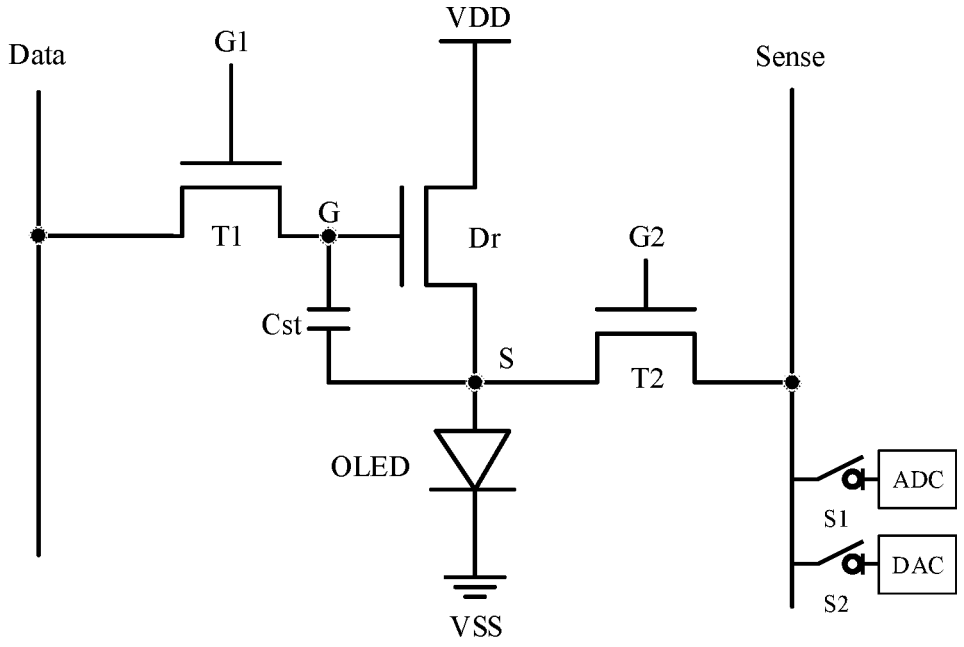
FIG. 1 (Prior art)
FIG. 1 is a schematic diagram of a pixel circuit in the related art.

Example embodiments will now be described more fully with reference to the accompanying drawings. However, the example embodiments can be implemented in various forms, and should not be construed as being limited to the embodiments set forth herein; on the contrary, these embodiments are provided so that the present disclosure will be comprehensive and complete, and fully convey the concept of the example embodiments to those skilled in the art. The same reference numerals in the figures indicate the same or similar structures, and thus their detailed descriptions will be omitted. In addition, the drawings are only schematic illustrations of the present disclosure, and are not necessarily drawn to scale.

The terms "a", "an", "the", "said", and "at least one" are used to indicate the presence of one or more elements/components/etc.; the terms "including" and "having" are used to indicate open-ended inclusive meaning and mean that in addition to the listed elements/components/etc., there may be other elements/components/etc.; the terms "first", "second", etc. are only used as marks, not to limit the number of the objects.

The transistor of the embodiment of the present disclosure refers to an element at least including three terminals of a gate, a drain, and a source. The transistor has a channel region between the drain (the drain terminal, drain region, or drain electrode) and the source (the source terminal, source region, or source electrode), and the current can flow through the drain, the channel region, and the source. The channel region refers to the region through which the current mainly flows. At the same time, the gate can be the control terminal, the drain can be the first electrode, and the source can be the second electrode, or the first electrode can be the source and the second electrode can be the drain. When transistors with opposite polarities are used, or when the direction of the current changes during operation of the circuit, the functions of "source" and "drain" may be interchanged. Therefore, in this specification, "source" and "drain" can be interchanged.

The transistors used in the embodiments of the present disclosure may include any of P-type transistors and N-type transistors, wherein the P-type transistor is turned on when the gate is at a low level and turned off when the gate is at a high level, and the N-type transistor is turned on when the gate is at a high level, and turned off when the gate is at a low level.

In the related art, as for an OLED (Organic Light-Emitting Diode) display panel, the OLED display panel may include a plurality of pixel units, and each pixel unit includes a pixel circuit and a light-emitting element, and the pixel circuit can be compensated by means of external compensation to improve the display effect. Specifically, as for the pixel circuit, the pixel circuit is usually necessary to compensate output characteristics of the driving transistor by sensing the threshold voltage and mobility of the driving transistor to solve various problems in the field, such as uneven brightness, and improve the display effect. When the mobility is sensed, it is necessary to sense the voltage of the sensing line connected to the driving transistor in order to detect the threshold voltage and mobility of the driving transistor.

Taking a pixel circuit of a pixel unit in the related art as an example, as shown in FIG. 1, the pixel circuit includes a first transistor T1, a second transistor T2, a driving transistor Dr, and a storage capacitor Cst.

The first electrode of the first transistor T1 is connected to the data line Data, and the second electrode of the first transistor T1 is connected to the gate of the driving transistor Dr. The first electrode of the driving transistor Dr is connected to the first power terminal VDD, the second electrode of the driving transistor Dr is connected to an electrode of a light-emitting element OLED, and the other electrode of the light-emitting element OLED is connected to the second power terminal VSS. The first electrode of the second transistor T2 is connected to the second electrode of the driving transistor Dr, and the second electrode of the second transistor T2 is connected to the sensing line Sense. The storage capacitor Cst is connected between the gate and the second electrode of the driving transistor Dr.

The sensing line Sense is connected to an analog-to-digital converter ADC through a first switch unit S1, and the sensing line Sense is also connected to a digital-to-analog converter DAC through a second switch unit S2. The first switch unit S1 can be controlled by a sampling signal to turn on or off, and the second switch unit S2 can be controlled by a switch signal to turn on or off. Both the first switch unit S1 and the second switch unit S2 are turned on in a high level state.

Figure 2:
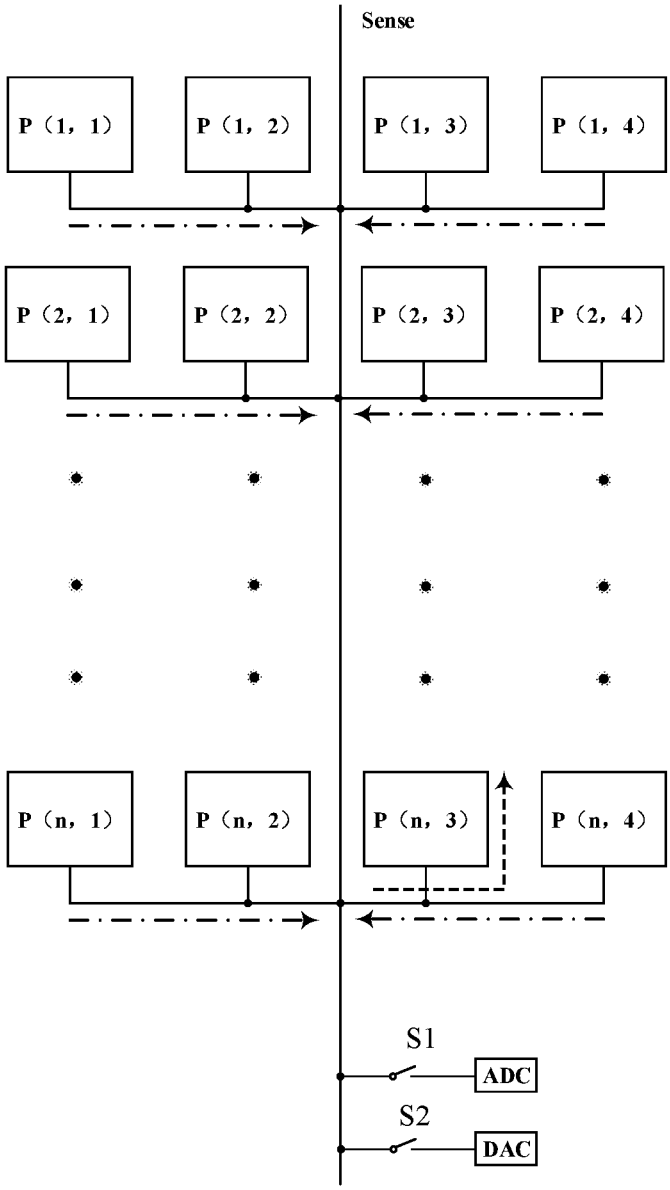
FIG. 2 (Prior art)
FIG. 2 is a schematic diagram of current leakage when a threshold voltage is detected in the related art.
Figure 4:
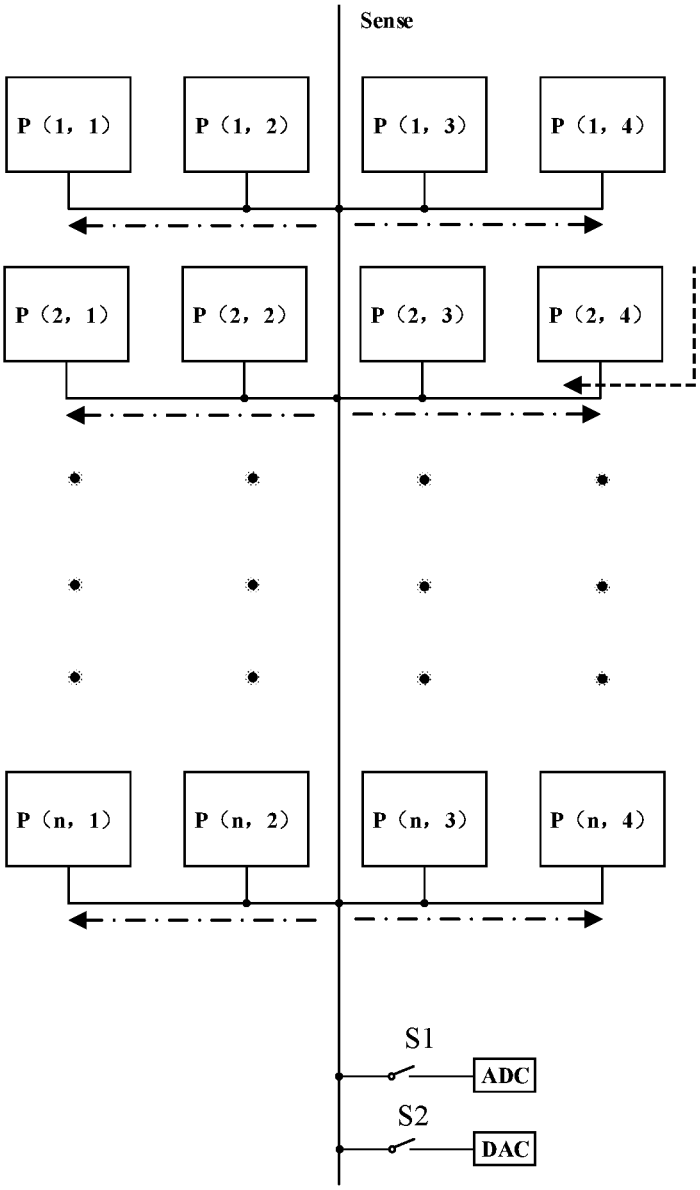
FIG. 4 (Prior art)
FIG. 4 is a schematic diagram of current leakage when mobility is detected in the related art.

As shown in FIGS. 2 and 4, the display panel has a plurality of pixel units P arrayed in the row direction and column direction. In FIGS. 2 and 4, P(n, m) is used to indicate that the pixel unit P of the n-th row and the m-th column, and both n and m are positive integers. The sensing line Sense can extend along the column direction, and the pixel circuits of any column of pixel units P are connected to the same sensing line Sense, and the same sensing line Sense can be connected to a plurality of columns of pixel circuits. The row direction and the column direction only refer to two directions perpendicular to each other, and do not limit their actual orientation. Those skilled in the art can know that if the display panel rotates, the actual orientation of the row direction and the column direction will also change.

As for driving transistors, due to the inevitable current leakage phenomenon, especially for LTPS (Low Temperature Poly-Silicon) transistors, the leakage current is large, it can leak through the sensing line Sense, and the detection result of the threshold voltage and mobility is based on detecting the voltage on the sensing line Sense, therefore, the current leakage of the driving transistor will affect the accuracy of the detection result of the threshold voltage and mobility, thereby affecting the final compensation effect.

Figure 3:
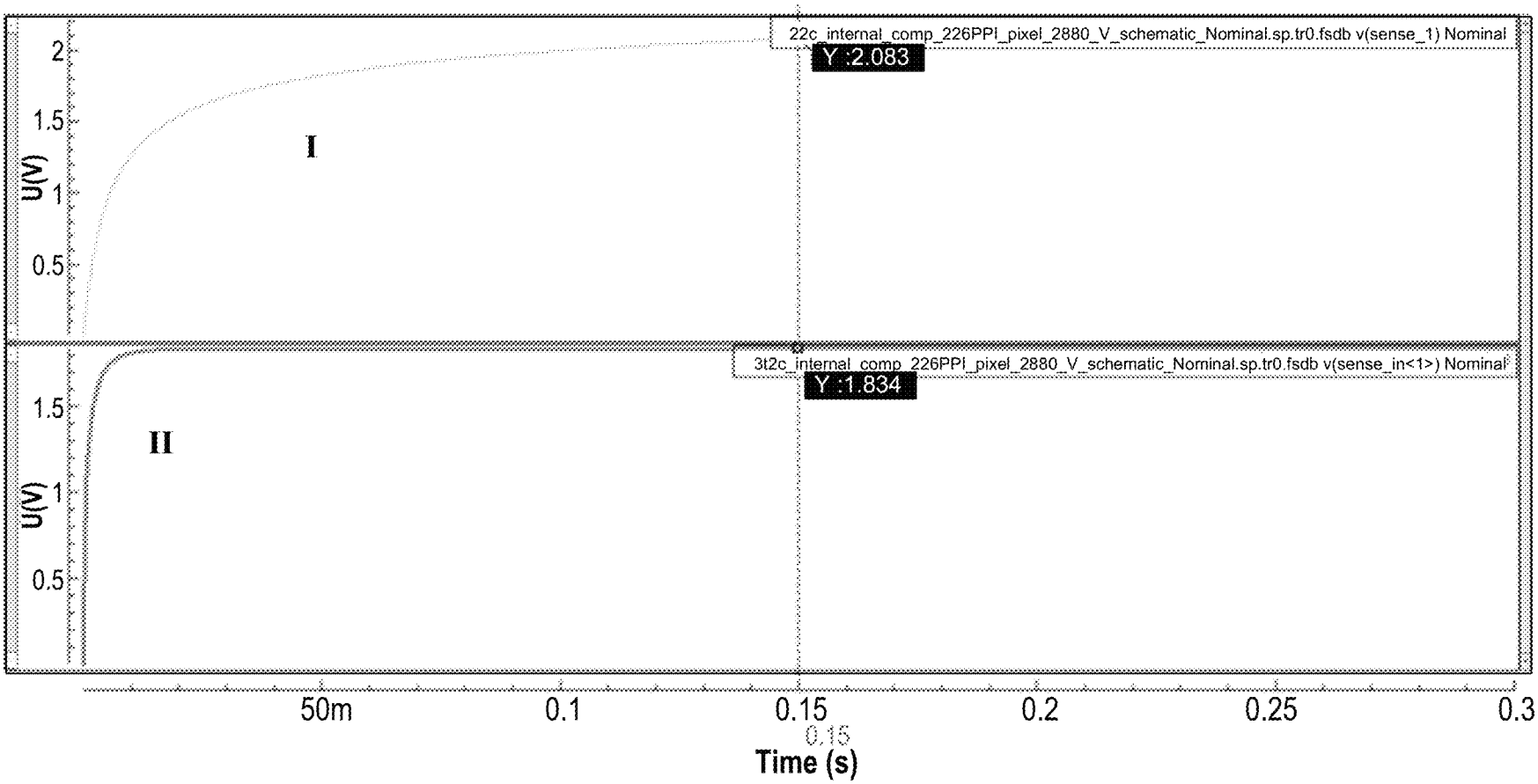
FIG. 3 is a simulation result diagram of current leakage when a threshold voltage is detected in the related art.

For example, when the threshold voltage of a driving transistor is detected, the light-emitting element can be in a turn-off state. As shown in FIG. 2, all the pixel units P connected to the sensing line Sense do not emit light. When the threshold voltage of a certain pixel unit P is detected, the pixel unit P charges the sensing line Sense, and the sensing line Sense will leak current to the remaining pixel units P due to the current leakage of the driving transistor Dr. As shown in FIG. 3, the curve I in FIG. 3 shows the detection result of the threshold voltage of the driving transistor when the sensing line Sense is connected to only one pixel circuit; the curve II shows the detection result of the threshold voltage of the driving transistor when the sensing line Sense is connected to 2880 rows of pixel circuits. By comparison, it can be seen that the detection result shown in curve II cannot reach the detection result of curve I due to the influence of the current leakage, and finally stays at 1.834V. The accuracy of the detection result is low, which affects the compensation effect.

As shown in FIG. 4, FIG. 4 shows the state of generating current leakage when mobility is detected. A sensing line Sense can be connected to four columns of pixel circuits. When mobility detection is performed on the pixel unit P (3, 2), except for the pixel units P (3, n) do not emit light, the remaining pixel units P are in a light-emitting state. At this time, the pixel units P that emit light will leak current to the sensing line Sense, and the sensing line Sense will leak current to the pixel units that do not emit light.

Figure 5:
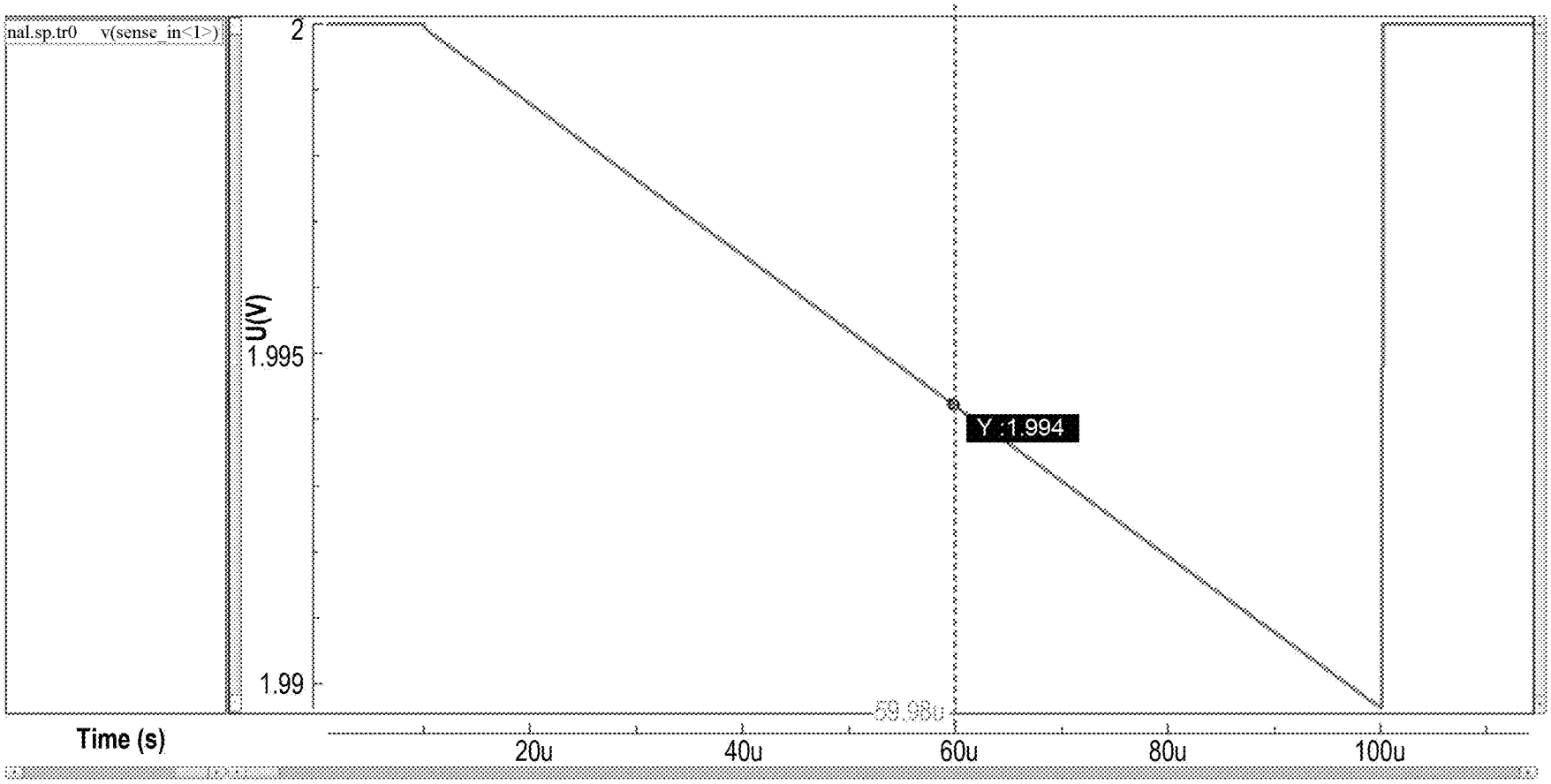
FIGS. 5 and 6 are simulation result diagrams of current leakage when mobility is detected in the related art.
Figure 6:
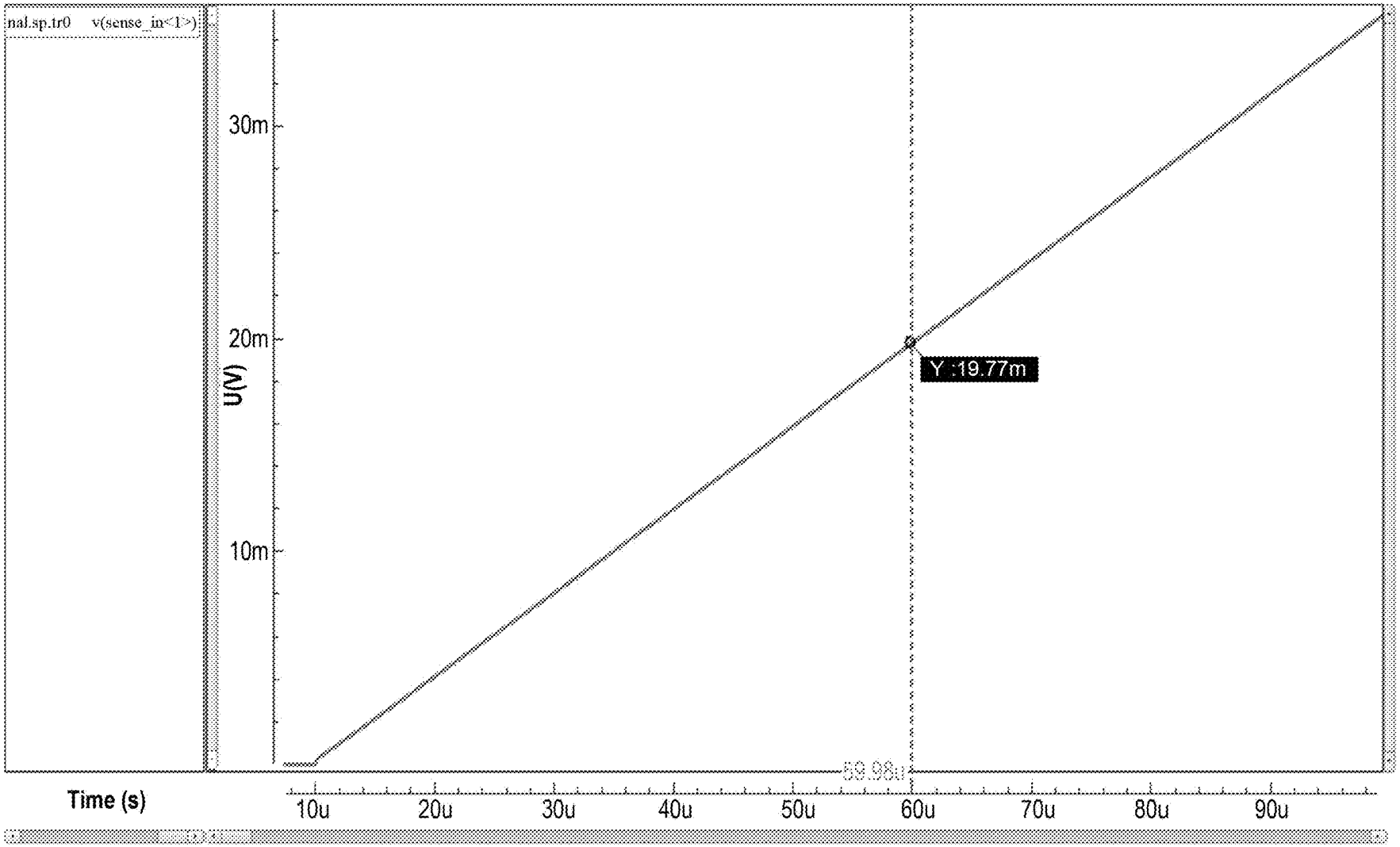

As shown in FIG. 5 and FIG. 6, in FIG. 5 and FIG. 6, a sensing line Sense is connected to 2880 rows of pixel circuits. In FIG. 5, the pixel units P connected to a sensing line Sense are all in the off state (not emitting light), and the sensing line Sense is set to a voltage of 2V. After 60 μs have elapsed, the voltage change ΔVA is 6 mV. In FIG. 6, the pixel units P connected to a sensing line Sense are all in a turn-on state (emitting light), and the sensing line Sense is set to 0V. After 60 μs have elapsed, the voltage change ΔVB is 19.77 mV. It can be seen that the current leakage of the driving transistor Dr will affect the accuracy of the detection result of the mobility, thereby affecting the compensation effect.

Figure 7:
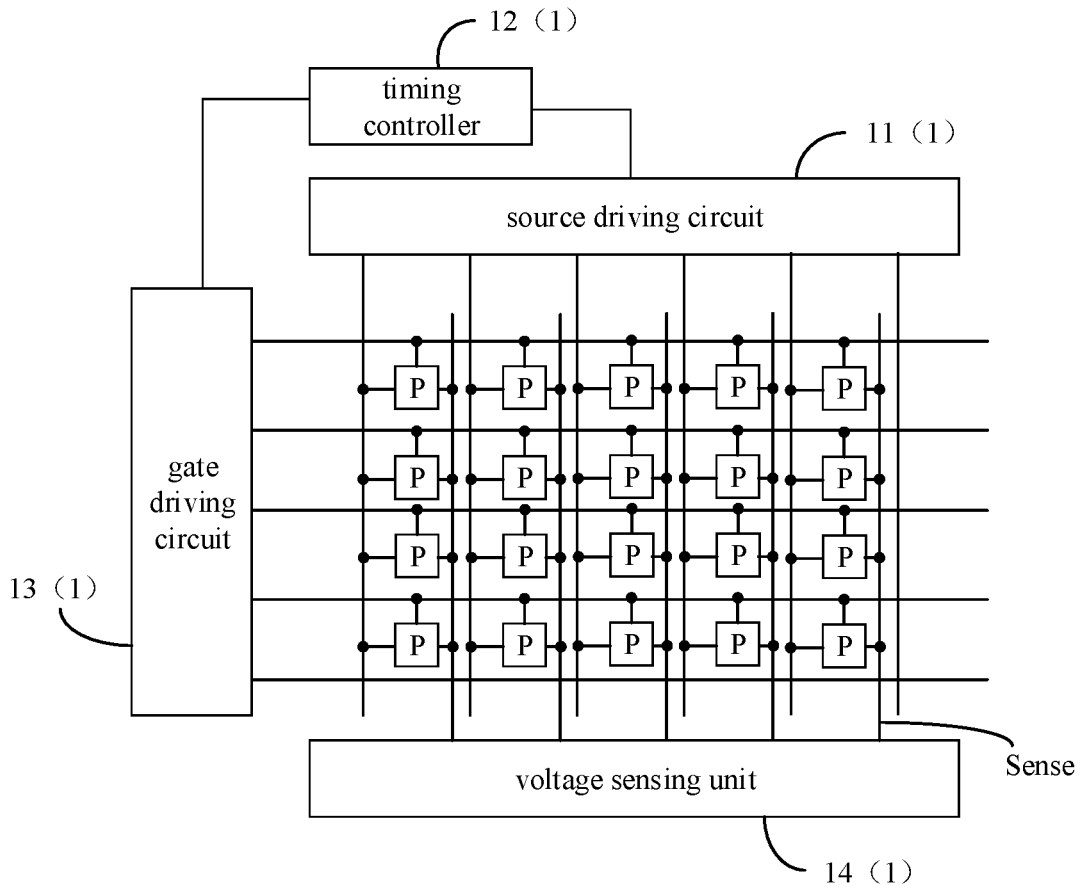
FIG. 7 is a schematic diagram of an embodiment of the display panel of the present disclosure.
Figure 8:
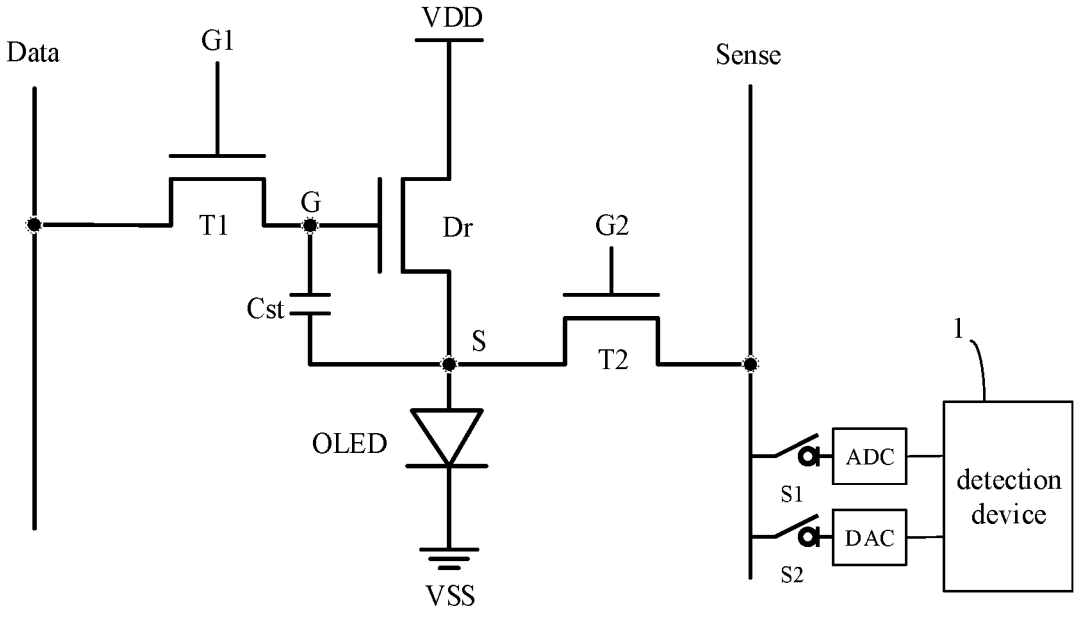
FIG. 8 is a schematic diagram of a pixel circuit in an embodiment of the display panel of the present disclosure.

Based on the above technical problems, embodiments of the present disclosure provide a display panel, as shown in FIG. 7 and FIG. 8, the display panel includes a pixel unit P and a detection device 1.

The number of pixel units P is multiple, and they are arranged in an array along the row direction and the column direction. Each pixel unit P may include a pixel circuit and a light-emitting element OLED connected to each other. The pixel circuit is used to drive the light-emitting element OLED to emit light. The structure of the light-emitting element OLED is not specially limited.

Each pixel circuit may include a first transistor T1, a driving transistor Dr, a second transistor T2, and a storage capacitor Cst.

A first electrode of the first transistor T1 is connected to a data line Data; a control terminal of the driving transistor Dr is connected to a second electrode of the first transistor T1, and a first electrode of the driving transistor Dr is connected to a first power terminal VDD. A first electrode of the second transistor T2 is connected to a second electrode of the driving transistor Dr, and a second electrode of the second transistor T2 is connected to a sensing line Sense; a first plate of the storage capacitor Cst is connected to the control terminal of the driving transistor Dr, a second plate of the storage capacitor Cst is connected to the second electrode of the driving transistor Dr and one electrode of the light-emitting element OLED, and the other electrode of the light-emitting element OLED is connected to the second power terminal VSS. The control terminal of the first transistor T1 is connected to the first control signal terminal G1, and the control terminal of the second transistor T2 is connected to the second control signal terminal G2.

The sensing line Sense may be connected to an analog-to-digital converter ADC through a first switch unit S1, and the sensing line Sense is also connected to a digital-to-analog converter DAC through a second switch unit S2. The first switch unit S1 can be controlled by a sampling signal Sam to turn on or off, and the second switch unit S2 can be controlled by a switch signal to turn on or off. Both the first switch unit S1 and the second switch unit S2 are turned on in a high level state. Both the first switching unit S1 and the second switching unit S2 may be transistors or other switching devices or switching circuits, and their structures are not specifically limited herein.

The pixel circuits of the pixel units P in the same column can be connected to the same sensing line Sense, and the number of pixel units P in one column of pixel units P is not specifically limited herein. At the same time, the same sensing line Sense can be connected to the pixel circuits of one or more columns of pixel units P. For example, the same sensing line Sense can be connected to the pixel circuits of four columns of pixel units P.

The detection device 1 can be used to perform following steps S110 to S130, where:

- step S110, in a first time period t1 in a first state of the pixel unit, turning off the first transistor T1 and the second transistor T2, and detecting an amount of current leakage of the driving transistor Dr through the sensing line Sense to obtain a first current leakage parameter;
- step S120, in a second time period t2 after the first time period t1 in the first state, detecting a first characteristic parameter of the driving transistor Dr to obtain a first reference characteristic parameter;
- step S130, determining a first target characteristic parameter according to the first current leakage parameter and the first reference characteristic parameter.

The display panel of the embodiment of the present disclosure can detect the current leakage of the driving transistor Dr through the sensing line Sense before detecting the first target characteristic parameter, that is, obtain the first current leakage parameter, and then determine the first target characteristic parameter according to the first current leakage parameter and the first reference characteristic parameter, that is, compensate the first reference characteristic parameter by the first current leakage parameter, to obtain the first target characteristic parameter, such that the detection result of the first characteristic parameter is more accurate, which is beneficial to improving the accuracy of external compensation, and then enhancing the display effect. The first target characteristic parameter may be the threshold voltage or mobility.

The process of detecting the first target characteristic parameter is exemplified below.

As shown in FIG. 7 and FIG. 8, in FIG. 8, G1 represents the timing of the first control signal terminal G1, G2 represents the timing of the second control signal terminal G2, Data represents the timing of the data line Data, and Sense represents the timing of the sensing line Sense, Sam represents the timing of the control terminal of the first switch unit S1.

As shown in FIGS. 7 and 8, in step S110, in a first time period t1 in a first state of the pixel unit P, the first transistor T1 and the second transistor T2 are turned off, and an amount of current leakage of the driving transistor Dr through the sensing line Sense is detected to obtain a first current leakage parameter;

The first transistor T1, the second transistor T2, and the driving transistor Dr may all be N-type LTPS transistors. The first characteristic parameter of the driving transistor Dr may be its threshold voltage.

The first state is the state of the pixel unit, which may be a non-display state, i.e., the state of each pixel unit when the display panel is in the off state. In the first state, each pixel unit P does not emit light, that is, no data signal for controlling the light-emitting element OLED to emit light is input to the data line Data. However, it should be noted that the first state is not a power-off state, but the light-emitting element OLED is turned off, the data line Data, the first power terminal VDD and the sensing line Sense can all input other electrical signals, as long as the light-emitting element OLED is not driven to emit light. The shutdown state of the display panel can be used to detect the threshold voltage (the first characteristic parameter), to avoid additionally adding time for detection. In other embodiments of the present disclosure, the first state may also be a display state, and the threshold voltage may be detected in the blanking stage of each frame to avoid affecting the display state.

The first time period t1 can be any time period in the first state. In the first time period t1, both the first transistor T1 and the second transistor T2 can be turned off. At the same time, by setting a certain voltage to the sensing line Sense, and detecting the voltage change of the sensing line Sense after a certain period of time, the influence of the current leakage of the driving transistor Dr on the voltage can be determined. As for a display panel, the threshold voltage of the driving transistor Dr can be detected after it is shut down every time and before it is started up at the next time.

As shown in FIG. 7 and FIG. 8, specifically, step S110 of detecting an amount of current leakage of the driving transistor Dr through the sensing line Sense to obtain a first current leakage parameter may include step S1110 to step S1130.

Step S1110, a first reference voltage is input to the sensing line Sense at an initial moment of the first time period t1.

The value of the first reference voltage is not specifically limited here, for example, it can be 2V. At the initial moment of the first time period t1, the second switch unit S2 can be turned on, the first reference voltage is input to the sensing line Sense through the detection device 1, and the first switch unit S1 is turned off.

Step S1120, a voltage of the sensing line Sense is detected at an end moment of the first time period t1, to obtain a first target voltage.

The duration of the first time period t1 is not particularly limited here. After the first time period t1 has elapsed, the first reference voltage set at the initial moment will be reduced due to the current leakage. Therefore, the first switch unit S1 can be turned on, the second switch unit S2 can be turned off, and the voltage of the sensing line Sense is detected to obtain the first target voltage. Due to the current leakage phenomenon, the first target voltage is less than the first reference voltage.

Step S1130, the first current leakage parameter is determined according to the difference between the first target voltage and the first reference voltage.

The first current leakage parameter may be the difference between the first reference voltage and the first target voltage. The first current leakage parameter can reflect the influence of the current leakage of the driving transistor Dr on the voltage of the sensing line Sense, so that the detection result of the threshold voltage can be corrected by the first current leakage parameter, to improve the accuracy of the detected threshold voltage.

The calculation formula of the first current leakage parameter is as follows:

$$\Delta V1 = Vs1 - Vt1;$$

×V1 is the first current leakage parameter, Vs1 is the first reference voltage, and Vt1 is the first target voltage.

In step S120, in a second time period t2 after the first time period t1 in the first state of the pixel unit, a first characteristic parameter of the driving transistor Dr is detected to obtain a first reference characteristic parameter.

The second time period t2 is after the first time period t1, and the duration of the second time period t2 is not specifically limited herein. In the second time period t2, the threshold voltage of the driving transistor Dr can be detected to obtain the reference value of the threshold voltage, i.e., the first reference characteristic parameter.

For example, step S120 may include step S1210 and step S1220.

Step S1210, the first transistor T1 and the second transistor T2 are turned on, a first reference voltage is written to the control terminal of the driving transistor Dr, and a first starting voltage is written to the second electrode of the driving transistor Dr, such that the driving transistor Dr is turned on.

The first reference voltage is greater than the first starting voltage, and the gate-source voltage difference Vgs of the driving transistor Dr can be equal to the difference between the first reference voltage and the first starting voltage. If Vgs is greater than the threshold voltage, the driving transistor Dr can be turned on.

Step S1220, a current is input to the first electrode of the driving transistor Dr, and a voltage of the second electrode of the driving transistor Dr when the driving transistor Dr is turned off is detected, serving as the first reference characteristic parameter.

After the driving transistor Dr is turned on, the first power supply terminal VDD inputs a current to the first electrode of the driving transistor Dr, so that the voltage of the second electrode of the driving transistor Dr gradually increases. During this process, the first switching unit S1 can be turned on, the detection device 1 can detect the voltage of the second electrode of the driving transistor Dr through the sensing line Sense. When the driving transistor Dr is turned off, it indicates that the difference between the first reference voltage and the first starting voltage reaches the critical value that turns on the driving transistor D, i.e., the threshold voltage. When the magnitudes of the first reference voltage and the first starting voltage are known, the reference value of the threshold voltage, i.e., the first reference characteristic parameter, can be calculated.

As shown in FIGS. 7 and 8, in step S130, a first target characteristic parameter is determined according to the first current leakage parameter and the first reference characteristic parameter.

Since the first current leakage parameter can be used to reflect the influence of the current leakage of the driving transistor Dr on the voltage of the sensing line Sense, the first current leakage parameter can be used to compensate the first reference characteristic parameter, so as to obtain the first target characteristic parameter. That is, Vth=Vths+ΔV1, where Vth is the first target characteristic parameter, Vths is the first reference characteristic parameter.

Further, in some embodiments of the present disclosure, the detection device 1 is also used to reset the voltage of the sensing line Sense in a first reset time period t5 between the first time period t1 and the second time period t2. For example, the voltage of the sensing line Sense is made to be zero.

In addition, in order to further improve the accuracy of the detection result, the duration of the first time period t1 and the second time period t2 can be made the same, that is, the duration of detecting the first current leakage parameter is the same as the duration of detecting the first reference characteristic parameter, so that the first current leakage parameter can reflect the current leakage situation in the process of detecting the first reference characteristic.

Figure 9:
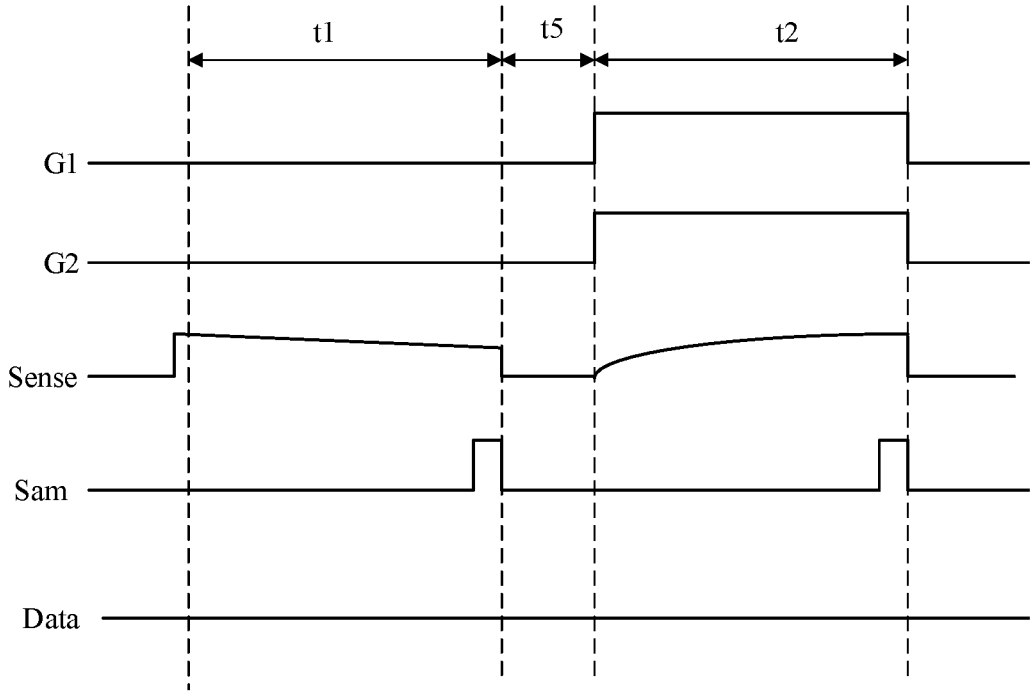
FIG. 9 is a first timing diagram of a detection method in an embodiment of the display panel of the present disclosure.
Figure 10:
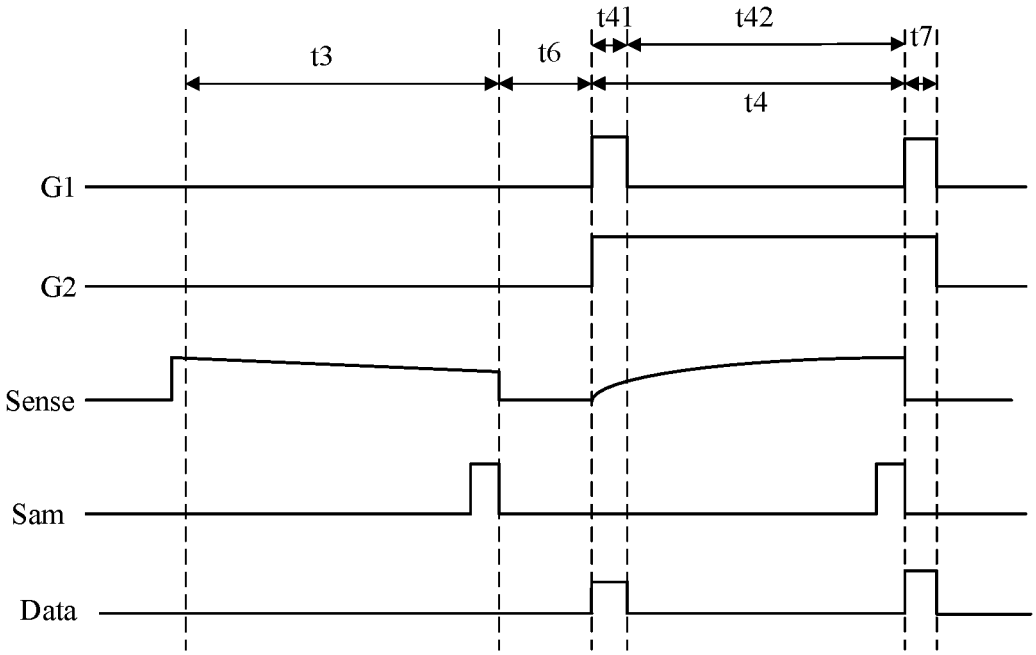
FIG. 10 is a second timing diagram of the detection method in an embodiment of the display panel of the present disclosure.

Based on the above-mentioned detecting the first characteristic parameter (threshold voltage), the detection device 1 can also be used to detect the second characteristic parameter, so as to determine to compensate the data signal for driving the pixel unit P to emit light according to the first characteristic parameter and the second specific parameter. On the basis that the first characteristic parameter is the threshold voltage, the second characteristic parameter may be mobility. As shown in FIG. 7 and FIG. 9, in some embodiments of the present disclosure, the detection device 1 is further configured to perform the following steps S210 to S230 to detect the mobility of the driving transistor Dr.

Step S210, in a third time period t3 in the second state of the pixel unit, the first transistor T1 and the second transistor T2 are turned off, and an amount of current leakage of the driving transistor Dr through the sensing line Sense is detected obtain a second current leakage parameter.

Step S220, in a fourth time period t4 after the third time period t3 in the second state, a second characteristic parameter of the driving transistor Dr is detected to obtain a second reference characteristic parameter.

Step S230, a second target characteristic parameter is determined according to the second current leakage parameter and the second reference characteristic parameter.

As shown in FIGS. 7 and 9, in FIG. 9, G1 represents the timing of the first control signal terminal G1, G2 represents the timing of the second control signal terminal G2, Data represents the timing of the data line Data, and Sense represents the timing of the sensing line Sense, Sam represents the timing of the control terminal of the first switch unit S1.

The process of detecting the second target characteristic parameters is exemplified below.

In step S210, in a third time period t3 in the second state of the pixel unit, the first transistor T1 and the second transistor T2 are turned off, and an amount of current leakage of the driving transistor Dr through the sensing line Sense is detected to obtain a second current leakage parameter.

The second state is the state of the pixel unit P, which can be a display state, that is, the state of each pixel unit P when the display panel is in a power-on state. The blanking stage of each frame can be used to detect the mobility (the second characteristic parameter) to avoid additionally adding time for detection. In other embodiments of the present disclosure, the second state may also be a non-display state, and the threshold voltage may be detected in the shutdown state to avoid affecting the display state.

The third time period t3 can be any time period in the first state. In the third time period t3, both the first transistor T1 and the second transistor T2 can be turned off. At the same time, by setting a voltage to the sensing line Sense, and detecting the voltage change of the sensing line Sense after a certain period of time, the influence of the current leakage of the driving transistor Dr on the voltage can be determined. Specifically, an amount of current leakage of the driving transistor Dr through the sensing line Sense is detected to obtain a second current leakage parameter; that is, step S210 may include step S2110-step S2130.

Step S2110, the sensing line Sense is set to the second reference voltage at an initial moment of the third time period t3.

The value of the second reference voltage is not specifically limited here, for example, it may be iv. At the initial moment of the first time period t1, the second switch unit S2 can be turned on, the first reference voltage is input to the sensing line Sense through the detection device 1, and the first switch unit S1 is turned off.

Step S2120, a voltage of the sensing line Sense at an end moment of the third time period t3 is detected, to obtain a second target voltage.

The duration of the third time period t3 is not specifically limited here. After the third time period t3 has elapsed, the voltage set at the initial time will decrease due to the current leakage. Therefore, the first switch unit S1 can be turned on, the second switch unit S2 can be turned off, and the voltage of the sensing line Sense is detected to obtain the second target voltage. Due to the existence of the current leakage phenomenon, the second target voltage is less than or greater than the second reference voltage. Specifically, if the second current leakage parameter of the pixel circuit of the pixel unit that emits light is detected, it may leak current to other pixel units through the sensing line Sense, so the second target voltage is less than the second reference voltage; if the second current leakage parameter of the pixel circuit of the pixel unit that emits light is detected, the pixel circuit may receive the current leakage of other pixel units that emit light, so that the second target voltage is higher than the second reference voltage.

Step S2130, the second current leakage parameter is determined according to the difference between the second target voltage and the second reference voltage.

The second current leakage parameter can be the difference or the sum of the second reference voltage and the second target voltage, which can reflect the influence of the current leakage of the driving transistor Dr on the voltage of the sensing line Sense through the second current leakage parameter, so that the detection result of the threshold voltage can be corrected through the second current leakage parameter, to improve the accuracy of the detected threshold voltage.

The calculation formula of the second current leakage parameter is as follows:

$$\Delta V2=Vs2-Vt2;$$

where ΔV2 is the second current leakage parameter, Vs2 is the second reference voltage, and Vt2 is the second target voltage.

In step S220, in a fourth time period t4 after the third time period t3 in the second state, a second characteristic parameter of the driving transistor Dr is detected to obtain a second reference characteristic parameter.

The fourth time period t4 is after the third time period t3, and the duration of the fourth time period t4 is not specifically limited here. In the fourth time period t4, the mobility of the driving transistor Dr can be detected to obtain the reference value of the mobility, i.e., the second reference characteristic parameter.

The step S220 of detecting a second characteristic parameter of the driving transistor Dr to obtain a second reference characteristic parameter may include following steps.

In a reset stage, the first transistor T1 and the second transistor T2 are turned on, a second reference voltage is input to the control terminal of the driving transistor Dr, the second reference voltage is equal to a sum of a basic voltage and the first characteristic parameter; and a reset voltage is input to the sensing line Sense.

The value of the basic voltage is not specifically limited here, and the first characteristic parameter is the threshold voltage of the driving transistor Dr detected in the first state last time. The second reference voltage can be input to the control terminal of the driving transistor Dr through the data line Data, so that the driving transistor Dr is turned on. Inputting the reset voltage to the sensing line Sense can reset the second electrode of the driving transistor Dr in different pixel driving circuits to the same voltage value, thereby avoiding the voltage of the second electrode of the driving transistor Dr from affecting the voltage of the sensing line Sense during the reset stage.

During the charging stage, the first transistor T1 is turned off, and the second transistor T2 is turned on. The driving transistor Dr inputs a driving current to the sensing line Sense under the action of the second reference voltage, so that the voltage of the sensing line Sense gradually rises.

In the detecting stage, the first switching unit 1 and the second switching unit 2 are turned off, and the voltage on the sensing line Sense is detected, to obtain the detection voltage.

The second reference voltage and the reset voltage can keep the gate-source voltage difference of the driving transistor Dr unchanged, thereby outputting a stable current. According to the formula $I=K(Vgs-Vth)^2=CV/t$, the mobility K of the driving transistor Dr can be calculated.

Where, Vgs is the gate-source voltage difference of the driving transistor Dr, $Vgs=Vd+Vth-Vf$; Vd is the basic voltage; Vth is the first target characteristic parameter, i.e., the threshold voltage of the driving transistor Dr; and Vf is the reset voltage.

C represents the capacitance value of the sensing line Sense itself, V represents the voltage value of the sensing line detected in the detecting stage, i.e., the detection voltage; t represents the duration of the charging stage.

In the calculation stage, the second reference characteristic parameter of the driving transistor Dr is determined according to the second reference voltage and the detection voltage.

According to the detection voltage, the reference value of the mobility, i.e., the second reference characteristic parameter, can be determined.

In step S230, a second target characteristic parameter is determined according to the second current leakage parameter and the second reference characteristic parameter.

Since the second current leakage parameter can be used to reflect the influence of the current leakage of the driving transistor Dr on the voltage of the sensing line Sense, the second current leakage parameter can be used to compensate the first reference characteristic parameter, to obtain the second target characteristic parameter, that is, $K=Ks+\Delta V2$, where K is the second target characteristic parameter, Ks is the first reference characteristic parameter. It should be noted that $\Delta V2$ may be a positive value or a negative value. That is, the second reference voltage may be less than or greater than the second target voltage.

Further, in some embodiments of the present disclosure, the detection device 1 is also used to reset the voltage of the sensing line Sense in a second reset time period t6 between the third time period t3 and the fourth time period t4, that is, the voltage of the sensing line Sense is made to be zero.

In addition, in order to further improve the accuracy of the detection result, the duration of the third time period t3 and the fourth time period t4 can be the same, that is, the duration of detecting the second current leakage parameter is the same as the duration of detecting the second reference characteristic parameter, so that the second current leakage parameter can reflect the current leakage situation in the process of detecting the second reference characteristic parameter. The third time period t3, the second reset time period and the fourth time period t4 are in the blanking stage.

Further, since the mobility detection is performed in the blanking stage, in order to avoid affecting the image display, after the fourth time period t4, that is, after the mobility detection is completed, data write-back can be performed. The specific principle of the data write-back operation is not discussed in detail here. The data write-back operation is performed in the data write-back stage t7.

In some embodiments of the present disclosure, as shown in FIG. 7, the detection device 1 may include: a source driving circuit 11, a timing controller 12, and a processor (not shown in the figure). The source driving circuit 11 can be connected to the pixel circuit through the data line Data; the timing controller 12 is connected to the source driving circuit 11, for controlling the source driving circuit 11 to input the first reference voltage and the second reference voltage to the data line Data, the processor is used to determine the threshold voltage and mobility of the driving transistor Dr according to the detected voltage of the sense line Sense.

The source driving circuit 11 in the detection device 1 can share the source driving circuit for providing data signals in the display panel, and the timing controller 12 can share the timing controller for providing timing control signals in the display panel, and the processor can be integrated into the main circuit board in the display panel. As shown in FIG. 7, the detection device can also share the gate driving circuit 13 in the display panel, to provide gate driving signals to the first switching unit 51 and the second switching unit S2. The detection device 1 may further include a voltage sensing unit 14. The voltage sensing unit 14 is used for sensing the voltage on the sensing line Sense, and the voltage sensing unit 14 may also be integrated into the source driving circuit 11.

The present disclosure provides a method of detecting a pixel circuit, and the structure of the pixel circuit can refer to the pixel circuit in the implementation of the display panel. The detection method includes:

- in a first time period in a first state of the pixel unit, turning off the first transistor and the second transistor, and detecting an amount of current leakage of the driving transistor leaked through the sensing line to obtain a first current leakage parameter;
- in a second time period after the first time period in the first state, detecting a first characteristic parameter of the driving transistor to obtain a first reference characteristic parameter;

determining a first target characteristic parameter according to the first current leakage parameter and the first reference characteristic parameter.

The details of each step of the method of detecting a pixel circuit of the present disclosure have been described in the implementation of the display panel above, and will not be described in detail here.

The embodiments of the present disclosure provide a method for driving a display panel, wherein the display panel includes a plurality of pixel units, and each pixel unit includes a pixel circuit and a light-emitting element connected to each other. The structure of the display panel may refer to the above embodiments of the display panel. The driving methods include:

detecting a first target characteristic parameter of each of driving transistors in the pixel circuit by using the detection method of any of the foregoing embodiments;

in a driving stage of the display panel, compensating a data signal of the pixel circuit where the driving transistor is located according to a first target characteristic parameter of the driving transistor.

Further, the detection method of any of the above embodiments can also be used to detect the second target characteristic parameter of each driving transistor in the pixel circuit, and compensates the data signal of the pixel circuit where the driving transistor is located according to the first target characteristic parameter and the second target characteristic parameter of the driving transistor, thereby controlling the pixel unit to emit light.

The embodiments of the present disclosure also provide a display apparatus including the display panel of any of the above embodiments. The structure, driving method, and beneficial effects of the display panel may refer to the above embodiments, which will not be repeated here. The display apparatus may be an electronic device with an image display function, such as a mobile phone, a TV, a tablet computer, and the like.

It should be noted that although the various steps of the method in the present disclosure are described in a specific order in the drawings, it does not require or imply that these steps must be performed in the specific order, or that all the steps shown must be performed to achieve the desired result. Additionally or alternatively, some steps may be omitted, multiple steps may be combined into one step for execution, and/or one step may be decomposed into multiple steps for execution, or the like.

Those skilled in the art will easily think of other embodiments of the present disclosure after considering the specification and practicing the disclosure disclosed herein. This application is intended to cover any variations, uses, or adaptive changes of the present disclosure. These variations, uses, or adaptive changes follow the general principles of the present disclosure and include common knowledge or conventional technical means in the technical field that are not disclosed in the present disclosure. The description and the embodiments are only regarded as exemplary, and the true scope and spirit of the present disclosure are indicated by the appended claims.

What is claimed is:

1. A display panel, comprising:

a plurality of pixel units, wherein each of the pixel units comprises a pixel circuit and a light-emitting element connected to each other, and the pixel circuit comprises:

a first transistor, having a first electrode connected to a data line;

a driving transistor, having a control terminal connected to a second electrode of the first transistor, and a first electrode connected to a first power terminal;

a second transistor, having a first electrode connected to a second electrode of the driving transistor, and a second electrode connected to a sensing line;

a storage capacitor, connected between the control terminal of the driving transistor and the light-emitting element;

a detection device, wherein the detection device is configured to:

in a first time period in a first state of the pixel unit, turn off the first transistor and the second transistor, and detect an amount of current leakage of the driving transistor leaked through the sensing line to obtain a first current leakage parameter;

in a second time period after the first time period in the first state, detect a first characteristic parameter of the driving transistor to obtain a first reference characteristic parameter;

determine a first target characteristic parameter according to the first current leakage parameter and the first reference characteristic parameter.

2. The display panel according to claim 1, wherein detecting the amount of current leakage of the driving transistor leaked through the sensing line to obtain the first current leakage parameter comprises:

inputting a first reference voltage to the sensing line at an initial moment of the first time period;

detecting a voltage of the sensing line at an end moment of the second time period, to obtain a first target voltage; and determining the first current leakage parameter according to the first target voltage and the first reference voltage.

3. The display panel according to claim 2, wherein the detection device is further configured to: reset the voltage of the sensing line in a first reset time period between the first time period and the second time period.

4. The display panel according to claim 2, wherein the first time period and the second time period have an identical duration.

5. The display panel according to claim 2, wherein the first characteristic parameter is a threshold voltage; and the first state is a non-display state.

6. The display panel according to claim 5, wherein detecting the first characteristic parameter of the driving transistor to obtain the first reference characteristic parameter comprises:

turning on the first transistor and the second transistor, writing a first reference voltage to the control terminal of the driving transistor, and writing a first starting voltage to the second electrode of the driving transistor, such that the driving transistor is turned on; and inputting a current to the first electrode of the driving transistor, and detecting a voltage of the second electrode of the driving transistor when the driving transistor is turned off, as the first reference characteristic parameter.

7. The display panel according to claim 5, wherein the detection device is further configured to:

in a third time period in a second state of the pixel unit, turn off the first transistor and the second transistor, and detect an amount of current leakage of the driving transistor leaked through the sensing line to obtain a second current leakage parameter;

in a fourth time period after the third time period in the second state, detect a second characteristic parameter of the driving transistor to obtain a second reference characteristic parameter; and determine a second target characteristic parameter according to the second current leakage parameter and the second reference characteristic parameter.

8. The display panel according to claim 7, wherein detecting the amount of current leakage of the driving transistor leaked through the sensing line to obtain the second current leakage parameter comprises:

enabling the sensing line to input a second reference voltage at an initial moment of the third time period;

detecting a voltage of the sensing line at an end moment of the third time period, to obtain a second target voltage; and determining the second current leakage parameter according to the second target voltage and the second reference voltage.

9. The display panel according to claim 8, wherein the detection device is further configured to: reset the sensing line in a second reset time period between the third time period and the fourth time period.

10. The display panel according to claim 9, wherein the second characteristic parameter is mobility; the second state is a display state; and the third time period, the second reset time period, and the fourth time period are in a blanking stage.

11. The display panel according to claim 10, wherein detecting the second characteristic parameter of the driving transistor to obtain the second reference characteristic parameter comprises:

in a reset stage, turning on the first transistor and the second transistor, inputting a second reference voltage to the control terminal of the driving transistor, wherein the second reference voltage is equal to a sum of a basic voltage and the first characteristic parameter; and inputting a reset voltage to the sensing line;

in a charging stage, turning on the second transistor, and the driving transistor inputting a driving current to the sensing line under an action of a detection voltage, such that the voltage of the sensing line gradually rises;

in a detecting stage, detecting the voltage of the sensing line to obtain the detection voltage; and in a processing stage, determining the second reference characteristic parameter of the driving transistor according to the second reference voltage and the detection voltage.

12. The display panel according to claim 7, wherein the third time period and the fourth time period have an identical duration.

13. A method of detecting a pixel circuit, comprising:

providing the pixel circuit, wherein: the pixel circuit comprises a first transistor, a second transistor, a driving transistor, and a storage capacitor, a first electrode of the first transistor is connected to a data line; a control terminal of the driving transistor is connected to a second electrode of the first transistor, and a first electrode of the driving transistor is connected to a first power terminal; a first electrode of the second transistor is connected to a second electrode of the driving transistor, and a second electrode of the second transistor is connected to a sensing line; and the storage capacitor is connected between the control terminal of the driving transistor and a light-emitting element;

in a first time period in a first state, turning off the first transistor and the second transistor, and detecting an amount of current leakage of the driving transistor leaked through the sensing line to obtain a first current leakage parameter;

in a second time period after the first time period in the first state, detecting a first characteristic parameter of the driving transistor to obtain a first reference characteristic parameter; and determining a first target characteristic parameter according to the first current leakage parameter and the first reference characteristic parameter.

14. The detection method according to claim 13, wherein detecting the amount of current leakage of the driving transistor leaked through the sensing line to obtain the first current leakage parameter comprises:

inputting a first reference voltage to the sensing line at an initial moment of the first time period;

detecting a voltage of the sensing line at an end moment of the second time period, to obtain a first target voltage; and determining the first current leakage parameter according to the first target voltage and the first reference voltage.

15. The detection method according to claim 14, wherein the first characteristic parameter is a threshold voltage; and the first state is a non-display state.

16. The detection method according to claim 15, wherein the detection method is further configured to:

in a third time period in a second state, turn off the first transistor and the second transistor, and detect an amount of current leakage of the driving transistor leaked through the sensing line to obtain a second current leakage parameter;

in a fourth time period after the third time period in the second state, detect a second characteristic parameter of the driving transistor to obtain a second reference characteristic parameter; and determine a second target characteristic parameter according to the second current leakage parameter and the second reference characteristic parameter.

17. The detection method according to claim 16, wherein detecting the amount of current leakage of the driving transistor leaked through the sensing line to obtain the second current leakage parameter comprises:

enabling the sensing line to input a second reference voltage at an initial moment of the third time period;

detecting a voltage of the sensing line at an end moment of the third time period, to obtain a second target voltage; and determining the second current leakage parameter according to the second target voltage and the second reference voltage.

18. The detection method according to claim 17, wherein the second characteristic parameter is mobility; the second state is a display state; and the third time period, a second reset time period between the third time period and the fourth time period, and the fourth time period are in a blanking stage.

19. A method of driving a display panel, wherein the display panel comprises a plurality of pixel units, and each of the pixel units comprises the pixel circuit and the light-emitting element connected to each other; the driving method comprises:

detecting a first target characteristic parameter of each of driving transistors in the pixel circuit by using the detection method according to claim 13; and in a display state of the display panel, compensating a data signal of the pixel circuit where the driving transistor is located according to a first target characteristic parameter of the driving transistor.

20. A display apparatus, comprising:

a display panel, comprising;

a plurality of pixel units, wherein each of the pixel units comprises a pixel circuit and a light-emitting element connected to each other, and the pixel circuit comprises:

a first transistor having a first electrode connected to a data line;

a driving transistor having a control terminal connected to a second electrode of the first transistor, and a first electrode connected to a first power terminal;

a second transistor having a first electrode connected to a second electrode of the driving transistor, and a second electrode connected to a sensing line;

a storage capacitor connected between the control terminal of the driving transistor and the light-emitting element; and a detection device, wherein the detection device is configured to:

in a first time period in a first state of the pixel unit, turn off the first transistor and the second transistor, and detect an amount of current leakage of the driving transistor leaked through the sensing line to obtain a first current leakage parameter;

in a second time period after the first time period in the first state, detect a first characteristic parameter of the driving transistor to obtain a first reference characteristic parameter; and determine a first target characteristic parameter according to the first current leakage parameter and the first reference characteristic parameter.

* * * * *